US006227412B1

(12) United States Patent
Sweeton

(10) Patent No.: US 6,227,412 B1
(45) Date of Patent: May 8, 2001

(54) DIP TUBE FILTER FOR MANUALLY ACTUATED DISPENSER

(75) Inventor: Steve L. Sweeton, Lee's Summit, MO (US)

(73) Assignee: Saint-Gobain Calmar Inc., City of Industry, CA (US)

( * ) Notice: Subject to any disclaimer, the term of this patent is extended or adjusted under 35 U.S.C. 154(b) by 0 days.

(21) Appl. No.: 09/518,682

(22) Filed: Mar. 3, 2000

(51) Int. Cl.[7] ..... B67D 5/58

(52) U.S. Cl. ..... 222/189.1; 222/464.1; 222/383.1; 222/382

(58) Field of Search ..... 222/382, 383.1, 222/464.1, 189.1

(56) References Cited

U.S. PATENT DOCUMENTS

D. 240,036 5/1976 Tada .
3,804,258 4/1974 Okuniewski et al. .
4,107,043 8/1978 McKinney .
5,154,317 * 10/1992 Roppolo, III ..... 222/66
5,154,320 * 10/1992 Bolduc ..... 222/145
5,240,151 * 8/1993 Worm ..... 222/318
5,376,272 * 12/1994 Spearman ..... 210/463
5,497,945 * 3/1996 Steinberg et al. ..... 239/329

* cited by examiner

*Primary Examiner*—Gregory L. Huson
*Assistant Examiner*—Frederick C Nicolas
(74) *Attorney, Agent, or Firm*—Dykema Gossett PLLC

(57) ABSTRACT

A one-piece filter for the distal end of a dip tube of a manually actuated liquid sprayer has an elongated tubular body open at one end with a perforate bottom wall at its other end. The body has a first inner diameter and a smaller second inner diameter established by a plurality of inner spacers for engaging the dip tube. The perforate bottom wall has an open mesh area defined by a plurality of filter openings, a first set of which occupies a central area of the bottom wall within the second diameter, and a second set of which openings occupies an annular area of the bottom wall between the first and second diameters.

9 Claims, 1 Drawing Sheet

DIP TUBE FILTER FOR MANUALLY ACTUATED DISPENSER

BACKGROUND OF THE INVENTION

This invention relates generally to a filter mounted at the distal end of a dip tube of a manually actuated dispenser, and more particularly to such a filter as having a perforate area greater than the outer diameter of the dip tube to which the filter is attached to thereby avoid filter clogging and to minimize flow resistance of liquid product into the dip tube during pumping operation.

Known prior art dip tube filters, of one-piece or multiple part construction, typically include a mesh screen or the like having its perforate area confined within the interior diameter of the dip tube which thereby reduces the available mesh area for functioning as a filter. Moreover product flow into the dip tube is limited to that area immediately adjacent the end of the dip tube.

SUMMARY OF THE INVENTION

It is therefore an object of the present invention to improve upon the prior art dip tube filters by the provision of a one-piece, non-hinged dip tube filter having an open mesh area greater than the inner area of the dip tube to thereby improve upon the filtering function. The filter comprises an open tubular member having a perforate bottom wall, the dip tube to which the filter is attached being spaced inwardly of the inner wall of the tubular member by the provision of spacers. A greater open mesh area is therefore provided in which a portion of the perforated area lies in alignment with the inner diameter of the dip tube while another portion lies outside that inner diameter area. Moreover the spacers for the dip tube can provide for filtering of product along the length of the tubular filter from its open end into the distal end of the dip tube.

Other objects, advantages and novel features of the invention will become more apparent from the following detailed description of the invention when taken in conjunction with the accompanying drawings.

DETAILED DESCRIPTION OF THE INVENTION

Figure 1:
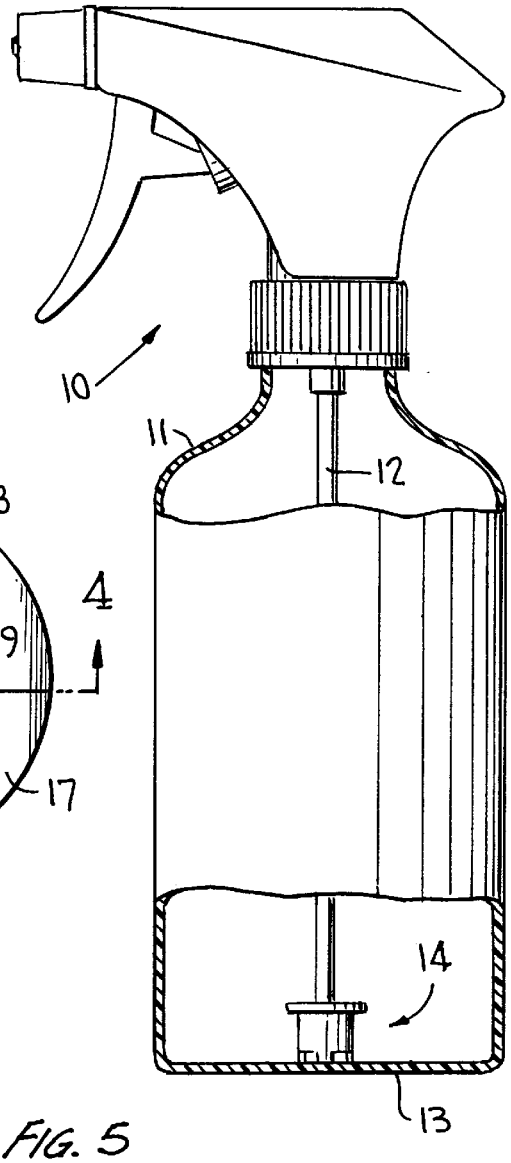
FIG. 1 is a side elevational view of the dip tube filter according to the invention shown attached to the distal end of the dip tube of a manually actuated liquid dispenser mounted to a container of liquid.

Turning now to the drawings wherein like reference characters refer to like and corresponding parts throughout the several views, FIG. 1 illustrates a known manually actuated liquid dispenser generally designated 10 mounted in known manner to the neck of a container 11 of product to be dispensed. The dispenser has a conventional dip tube 12 depending therefrom into the container toward bottom wall 13 thereof. The filter according to the invention, generally designated 14, as shown in more detail in FIGS. 2 to 5. The filter is mounted to the distal end of the dip tube and may rest against the bottom wall 13 of the container as shown in FIG. 1, or may track the contour of the container bottom wall when spraying in other than the upright position of FIG. 1.

The filter is of one-piece construction having a tubular side wall 15 with an open end 16 (FIGS. 4, 5) at which an outwardly extending annular flange 17 may be provided to facilitate the handling of the part during sub-assembly or the like.

Figure 2:
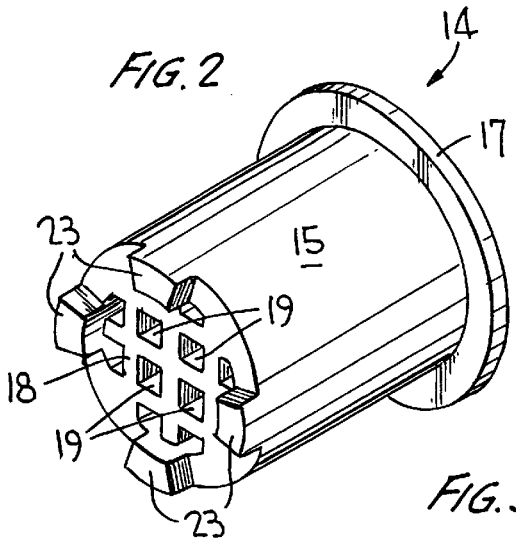
FIG. 2 is a bottom perspective view of the dip tube filter of FIG. 1.
Figure 3:
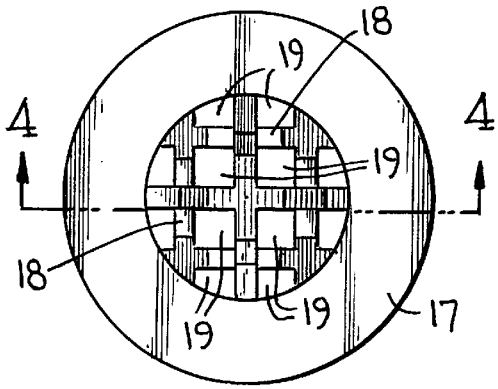
FIG. 3 is a top plan view of the filter of FIG. 2.
Figure 4:
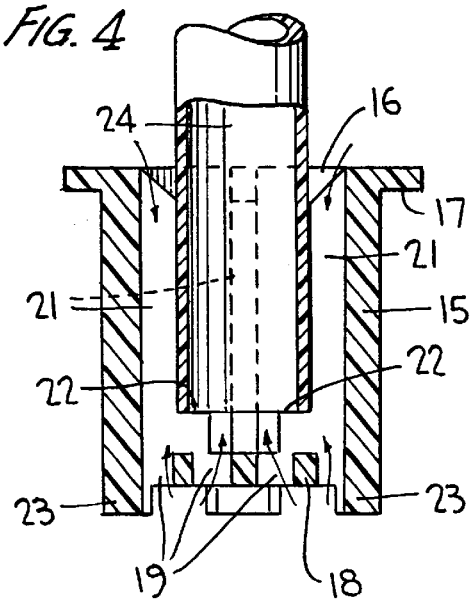
FIG. 4 is a sectional view taken substantially along the line 4—4 of FIG. 3 and showing the filter as mounted to the distal end of a dip tube.

The filter has at its end opposite open end 16 a bottom perforate wall 18 shown in FIGS. 2 to 4. Bottom wall 18 is an open mesh comprising a plurality of openings 19 having a mesh diameter substantially the same as the inner diameter of tubular side wall 15.

A plurality of spacers such as longitudinal ribs 21 or the like (FIGS. 4, 5) extend inwardly of the inner wall of sidewall 15. The distal end of the dip tube is centered within filter 14 by the ribs, and the dip tube is spaced by the ribs inwardly of tubular sidewall 15, as shown in detail in FIG. 4. Means other the longitudinal spacer ribs shown are possible, such as detents or the like, within the scope of the invention.

Spacers 21 are formed adjacent bottom wall 18 as presenting shoulders 22 for spacing the free end of the dip tube from perforate wall 18.

Figure 5:
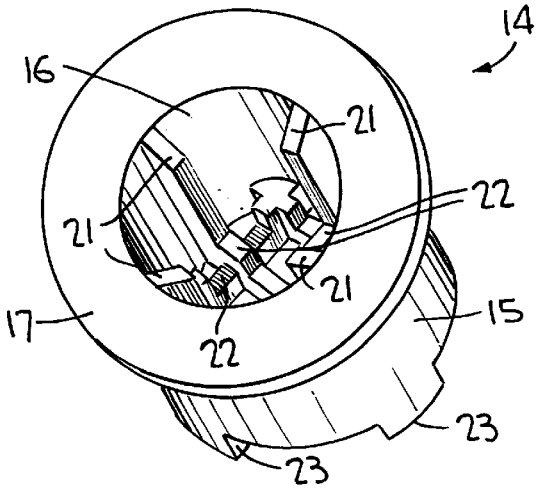
FIG. 5 is an upper perspective view of the dip tube filter according to the invention.

As shown in FIGS. 2, 4 and 5, the tubular sidewall may be provided with a plurality of legs 23 to unsure the spacing of the bottom perforate wall 18 from bottom wall 13 of the container to avoid any interference to free flow of product through the open mesh area thereof.

In operation, liquid is drawn into the dip tube during each suction stroke of the pump dispenser in a manner well known in this art. In the one-piece filter of the invention, bottom wall 18 has an open mesh area defined by openings 19 which approximate the area of the dip tube inner diameter which defines an inlet passage 24 leading to the valved inlet to the pump chamber (not shown) of the dispenser. As most clearly seen in FIG. 4, a portion of the open mesh area of the perforate bottom wall 18 is aligned with inlet passage 24 while the remaining portion of the open mesh area is out of alignment with the inlet passage. Thus during each suction stroke of the pump piston (not shown) liquid from the container is drawn into the inlet passage 24 defined by the dip tube via the open mesh area of perforate wall 18 as shown by the flow arrows in FIG. 4. The drawn-in liquid is thus filtered as it moves through both the openings of the perforate bottom wall which are aligned with inlet passages as well as those not in alignment therewith, i.e., outside the outer diameter of the dip tube. The spacing of the lower end of the dip tube from the perforate bottom wall, and the open mesh area of the bottom wall which approximates that of the inner diameter of the dip tube forming the inlet passage, permits drawn in liquid to be filtered as it passes through the perforate wall with a substantially reduced resistance to flow. Moreover, during the pump piston suction strokes the liquid is drawn in through the open end 16 of the filter between spacing ribs 21 which, depending on the number and relative closeness of such ribs to one another, may together define filter openings for the drawn in liquid. Thus liquid is drawn in as shown by the flow arrows at the open end of the filter so as to be thereby filtered by the spaced ribs as the drawn in liquid moves into inlet passage 24 via the free end of the dip tube. Although only four of such spacing ribs 21 are shown in the drawing, certainly many more of such ribs or equivalent spacers can be provided to define filter openings there between as in accordance with the invention.

From the foregoing it can be seen that a simple and economical yet highly highly effective dip tube filter has been devised having an open mesh area provided by a perforate bottom wall of the filter which approximate that of the area of the inlet passage defined by the dip tube. The tubular sidewall of the filter has a first inner diameter and a second smaller inner diameter defined by a plurality of inner spacers on the tubular wall. Thus a first set of the mesh openings of the perforate wall occupy a central area of the bottom wall within such second diameter, and a second set of such openings in the perforate bottom wall occupy an annular area of the bottom wall between the first and second diameters. Thus any resistance to flow of liquid through the open mesh area is minimized when suctioned into the inlet passage formed by the dip tube during each pump piston stroke of the dispenser. The free end of the dip tube is spaced from the perforate bottom wall, and the inner spacers together may define an open mesh area for filtering liquid drawn in from the open end of the filter during pumping operation. The liquid drawn in from that open end flows along the outside of the dip tube and into its inlet passage such that the filter according to the invention provides for a multiplicity of filter opening without the need for additional parts or without the need for any moving parts. The one-piece filter according to the invention may be quickly and easily molded and assembled in place and is designed to be spaced away from an inner wall of the container to avoid any blockage to free fluid flow during the suction pumping strokes.

Obviously many other modifications and variations of the present invention are made possible in the light of the above teachings. It is therefore to be understood that within the scope of the appended claims the invention may be practiced otherwise than as specifically described.

What is claimed is:

1. A one-piece filter for the distal end of a dip tube of a manually actuated liquid dispenser, comprising, an elongated tubular body open at one end and having a perforate bottom wall at its other end, said body having a first inner diameter and a smaller second inner diameter established by inner spacers for engaging the dip tube, said bottom wall having a plurality of filter openings, a first set of said openings occupying a central area of said bottom wall within said second diameter, a second set of said openings occupying an annular area of said bottom wall between said first and second diameters.

2. The one-piece filter according to claim 1, wherein said body has shoulders inwardly of said bottom wall for spacing the dip tube from the bottom wall.

3. The one-piece filter according to claim 1, wherein said body has spaced projections defining feet on an outer side of said bottom wall.

4. The dispenser according to claim 3, wherein said flow passage defining means comprise a plurality of ribs on said tubular side wall spaced closely together for filtering liquid when drawn in through the free end of the tube.

5. A manually actuated filtered liquid dispenser adapted for attachment to a container of liquid to be dispensed, comprising a dip tube depending from the dispenser into the container and defining an inlet passage, means attached to the dip tube for filtering liquid drawn from the container through the free end of the tube, said means comprising a tubular body member having a perforate bottom wall overlying the free end of the tube, means on said body member spacing a tubular sidewall thereof from the tubular wall of said dip tube and defining liquid flow passages from an upper end of said body member to the free end of the tube, said bottom wall having an open mesh area approximating the area of said inlet passage, a portion of said open mesh area being aligned with said inlet passage, whereby any resistance to flow through said open mesh area is reduced upon the drawing in of liquid through the free end of the tube.

6. The dispenser according to claim 3, wherein said flow passage defining means comprise ribs on said tubular side wall.

7. The dispenser according to claim 3, wherein legs extend from said tubular side wall beyond said bottom wall for spacing said bottom wall from an inner wall of the container.

8. The dispenser according to claim 5, wherein shoulders are provided on said tubular side wall for spacing the free end of the tube from said bottom wall.

9. The dispenser according to claim 4, wherein s shoulders are provided on said tubular side wall for spacing the free end of the tube from said bottom wall.

* * * * *